US010149525B2

(12) United States Patent
Gutierrez

(10) Patent No.: US 10,149,525 B2
(45) Date of Patent: Dec. 11, 2018

(54) HAIR COMB WITH PIVOTAL ADJUSTMENT FEATURE

(71) Applicant: Nicholas Ashley Gutierrez, Bonita, CA (US)

(72) Inventor: Nicholas Ashley Gutierrez, Bonita, CA (US)

( * ) Notice: Subject to any disclaimer, the term of this patent is extended or adjusted under 35 U.S.C. 154(b) by 426 days.

(21) Appl. No.: 14/934,046

(22) Filed: Nov. 5, 2015

(65) Prior Publication Data

US 2016/0316885 A1 Nov. 3, 2016

Related U.S. Application Data

(60) Provisional application No. 62/054,315, filed on Sep. 23, 2014.

(51) Int. Cl.

| | |
|---|---|
| ***A45D 24/14*** | (2006.01) |
| ***A45D 24/02*** | (2006.01) |
| ***A45D 24/16*** | (2006.01) |
| *A45D 24/12* | (2006.01) |

(52) U.S. Cl.

CPC ..... *A45D 24/14* (2013.01); *A45D 24/02* (2013.01); *A45D 24/16* (2013.01); *A45D 24/12* (2013.01)

(58) Field of Classification Search

CPC ..... A45D 24/02; A45D 24/04; A45D 24/10; A45D 24/12; A45D 24/14; A45D 24/16; A46B 5/028

USPC ..... 132/149, 128; D28/30, 34

See application file for complete search history.

(56) References Cited

U.S. PATENT DOCUMENTS

| | | | | | |
|---|---|---|---|---|---|
| 1,359,666 | A * | 11/1920 | Brandt | B26B 21/42 | 132/142 |
| 1,852,362 | A * | 4/1932 | Newby | A45D 2/42 | 132/140 |
| 2,150,260 | A * | 3/1939 | Berry | A45D 24/14 | 132/122 |
| 2,199,282 | A * | 4/1940 | Condron | A45D 24/14 | 132/149 |
| 5,259,114 | A * | 11/1993 | Shorter | B26B 13/24 | 132/148 |
| 5,533,537 | A * | 7/1996 | Mourad | A45D 19/02 | 132/113 |
| 6,047,705 | A * | 4/2000 | Hawley | A45D 8/00 | 132/128 |
| 8,191,557 | B2 * | 6/2012 | Saiki | A45D 24/36 | 132/200 |
| 2004/0003823 | A1 * | 1/2004 | Johnson | A45D 24/16 | 132/120 |

(Continued)

*Primary Examiner* — Tatiana Nobrega

(74) *Attorney, Agent, or Firm* — Plager Schack, LLP; Mark H. Plager; Eric Liou

(57) ABSTRACT

A comb for permitting a user to perform a scissor over comb technique on a subject's hair with enhanced efficiency is provided. The comb includes a frame having a handle, a neck and a spine, the handle having a finger rest on an intermediate portion able to receive a first finger of the user, a plurality of tines coupled to the spine, and a support band coupled to opposing sides of the finger rest on the handle. The user's first finger is disposed between the finger rest and the support band. A second finger of the user is pressed against the neck to pivot the tines downward into a generally horizontal plane. Removal of the second finger from the neck permits tension between the support band and first finger to pivot the tines upward into a generally vertical plane.

6 Claims, 6 Drawing Sheets

(56) References Cited

U.S. PATENT DOCUMENTS

| | | | | |
|---|---|---|---|---|
| 2005/0241661 | A1* | 11/2005 | Eddinger | A45D 24/04<br>132/139 |
| 2010/0242289 | A1* | 9/2010 | Roskam | B26B 13/20<br>30/232 |
| 2014/0251358 | A1 | 1/2014 | Temple | |
| 2014/0053860 | A1* | 2/2014 | Temple | A45D 24/16<br>132/200 |
| 2014/0373862 | A1 | 12/2014 | Prokop, III et al. | |

* cited by examiner

HAIR COMB WITH PIVOTAL ADJUSTMENT FEATURE

RELATED APPLICATION

The application claims priority to provisional patent application U.S. Ser. No. 62/054,315 filed on Sep. 23, 2014, the entire contents of which is herein incorporated by reference.

BACKGROUND

The embodiments herein relate generally to combs used when cutting an individual's hair.

Many barbers and cosmetologists use a technique referred to as scissor over comb hair cutting. This technique requires a user to maneuver a comb in one hand by rotating it forward and downward to comb an individual's hair, and rotating the comb upward to flip the hair up to be cut by a scissor. This downward and upward movement is repeated to comb and cut the hair until a desired hair length is achieved. By repeating this sequence, the user can cut the individual's hair and monitor hair length and placement when in a resting position.

The scissor over comb technique traditionally takes a user several years of practice to become proficient with the procedure. This technique is challenging and inefficient because it is difficult to rotate and control a comb with several fingers in a repetitive motion. In addition, the rotation of the comb with the user's fingers places great stresses on the wrist and hand over time, which often causes the user to suffer injuries or disorders such as tendinitis and/or carpal tunnel syndrome.

As such, there is a need in the industry for a hair comb that addresses the limitations of the prior art, which permits a user to perform the scissor over comb technique with enhanced efficiency and maintain neutrally aligned hand, wrist and arm positions to reduce the incidence of injuries. There is a further need in the industry for a hair comb that reduces the time required for a user to perform the scissor over comb technique competently.

SUMMARY

A comb for use in permitting a user to perform a scissor over comb technique on hair of a subject with enhanced efficiency is provided. The comb is configured to enable a user to pivotably adjust the comb and maintain the user's hand and wrist in a neutrally aligned position. The comb comprises a frame comprising a handle, a neck and a spine, the neck comprising a first end coupled to the handle and a second end coupled to the spine, the handle comprising a finger rest on an intermediate portion configured to receive a first finger of the user, a plurality of tines coupled to the spine, and a support band coupled to opposing sides of the finger rest on the handle, wherein the first finger of the user is disposed between the finger rest and the support band, wherein a second finger of the user is pressed against the neck to pivot the tines downward into a generally horizontal plane, wherein removal of the second finger from the neck permits tension between the support band and first finger to pivot the tines upward into a generally vertical plane.

BRIEF DESCRIPTION OF THE FIGURES

The detailed description of some embodiments of the invention will be made below with reference to the accompanying figures, wherein the figures disclose one or more embodiments of the present invention.

DETAILED DESCRIPTION OF CERTAIN EMBODIMENTS

Figure 1:
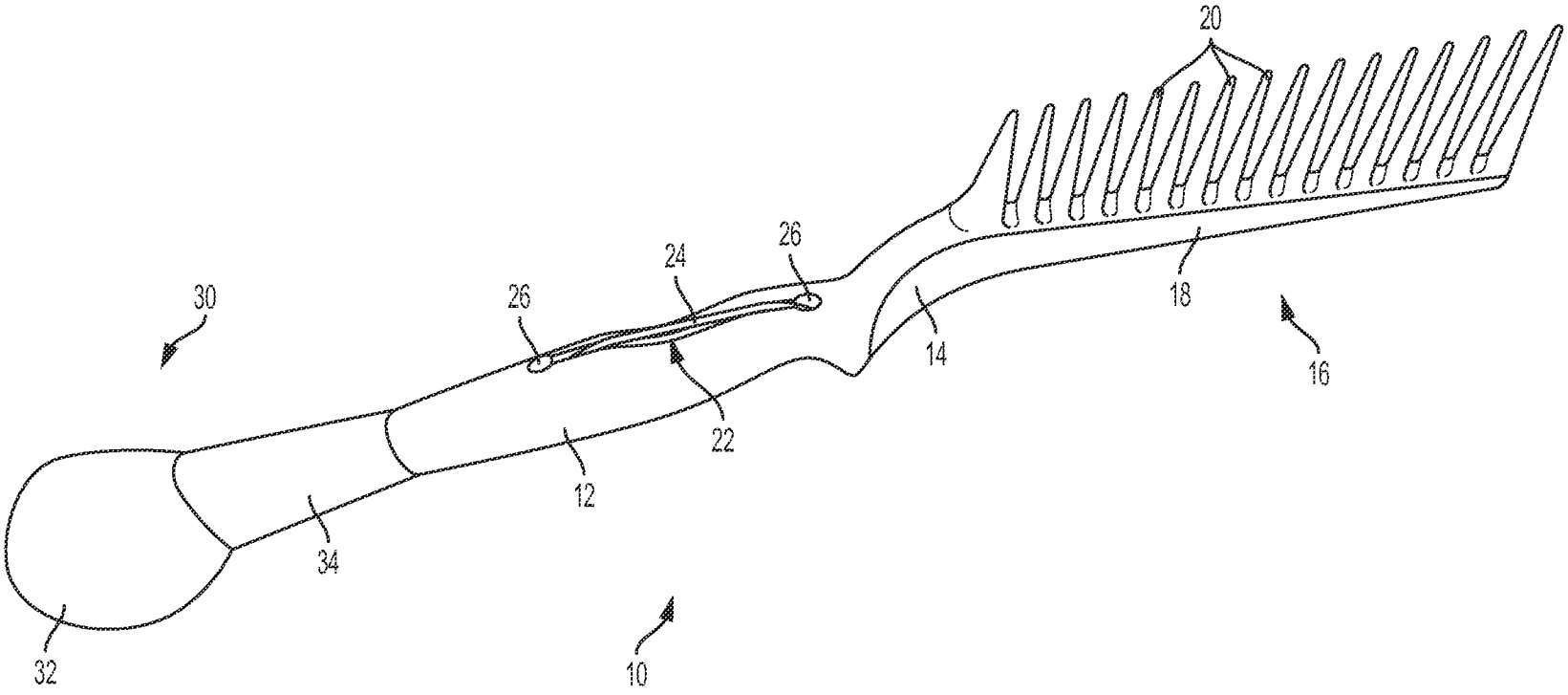
FIG. 1 depicts a perspective view of certain embodiments of the comb.
Figure 2:
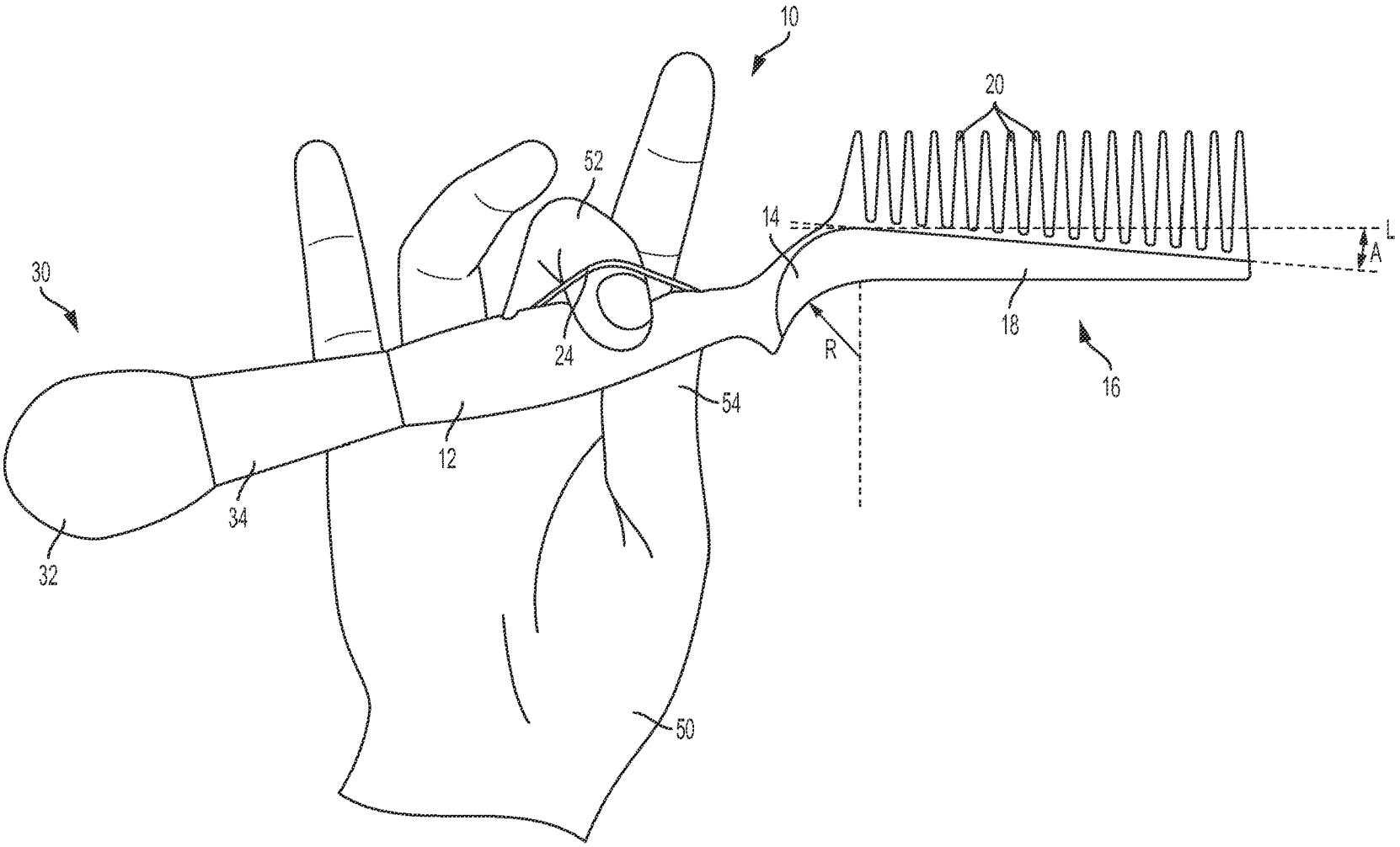
FIG. 2 depicts a front elevation view of certain embodiments of the comb shown in use.

As depicted in FIGS. 1-2, comb apparatus 10 is configured for use by operator 50 to comb and position hair on an individual (not shown) during a haircut. As will be apparent in the following disclosure, comb apparatus 10 is particularly useful in performing the scissor over comb hair cutting technique because it helps operator 50 to maintain a neutrally aligned and comfortable hand, wrist and arm position. This enables operator 50 to perform the technique with enhanced efficiency while reducing the chance he/she suffers a hand, wrist or arm-related stress injury.

Comb apparatus 10 generally comprises handle 12, neck 14 and comb member 16. Handle 12 comprises an elongated member configured to sit within the hand of operator 50. In a preferred embodiment, handle 12 comprises an approximate length of 4". However, alternative dimensions may be used instead. Handle 12 comprises finger rest portion 22 and slits 26 positioned on an upper exterior portion. Finger rest portion 22 is configured to receive middle finger 52 of operator 50. In certain embodiments, finger rest portion 22 has a surface preferably 1-2" wide and an outer surface configured to conform to contours of middle finger 52.

Slits 26 are disposed on handle 12 on opposing sides of finger rest portion 22. Each slit 26 comprises a hook member (not shown) disposed therein. Support band 24 is disposed within slits 26 and around the hook members therein. This enables support band 24 to extend above finger rest portion 22. As depicted in FIG. 2, middle finger 52 of operator 50 is disposed between support band 24 and finger rest portion 22. When middle finger 52 is in contact with both finger rest portion 22 and support band 24, tension in support band 24 secures comb apparatus 10 to the operator's hand. It shall be appreciated that support band 24 may be made from any stretchable, resilient and deformable material known in the field such as rubber.

Comb member 16 is coupled to handle 12 by neck 14. Comb member 16 comprises spine 18 and a plurality of tines 20 coupled thereto. In one embodiment, comb member 16 comprises a length of approximately 4.8" long. However, dimensions of comb member 16 may vary. The top surface of spine 18 is slanted to create an angle A defined by longitudinal axis L of the spine and the top surface of spine 18. In a preferred embodiment, angle A is approximately 4 degrees. However, angle A may be variable. The slanted surface of spine 18 permits the length of tines 20 to vary. In particular, tines 20 gradually increase in length from a first end of spine 18 proximate neck 14 to a second end of spine 18.

Neck 14 comprises a curvature that elevates tines 20 above handle 12. More specifically, neck 14 comprises a radius of curvature R that is approximately 1.0". As will be described later, this curvature is particularly important because it permits operator 50 to maintain neutrally aligned arm, wrist and hand positions while performing the scissor over comb technique. It shall be appreciated that handle 12, neck 14 and comb member 16 are preferably a single component made from plastic. However, other materials such as wood, metal, other polymers, or the like, may be used instead. In alternative embodiments, handle 12, neck 14 and comb member 16 may be separate components connected together.

In one embodiment, brush 30 is detachably coupled to an end of handle 12. Brush 30 comprises bristles 32 and brush arm 34. In a preferred embodiment, brush arm 34 is secured to handle 12 by magnets (not shown). In one embodiment, brush arm 34 comprises a positive magnet configured to engage with a negative magnet disposed within a recess (not shown) of handle 12. It shall be appreciated that alternative fastening components known in the field may be used to secure brush 30 to handle 12 including, but not limited to, hook and loop fasteners, snap components, screws, nails, or the like. During a haircut, operator 50 can detach brush 30 from handle 12 to brush cut hair off the individual as needed.

Figure 3:
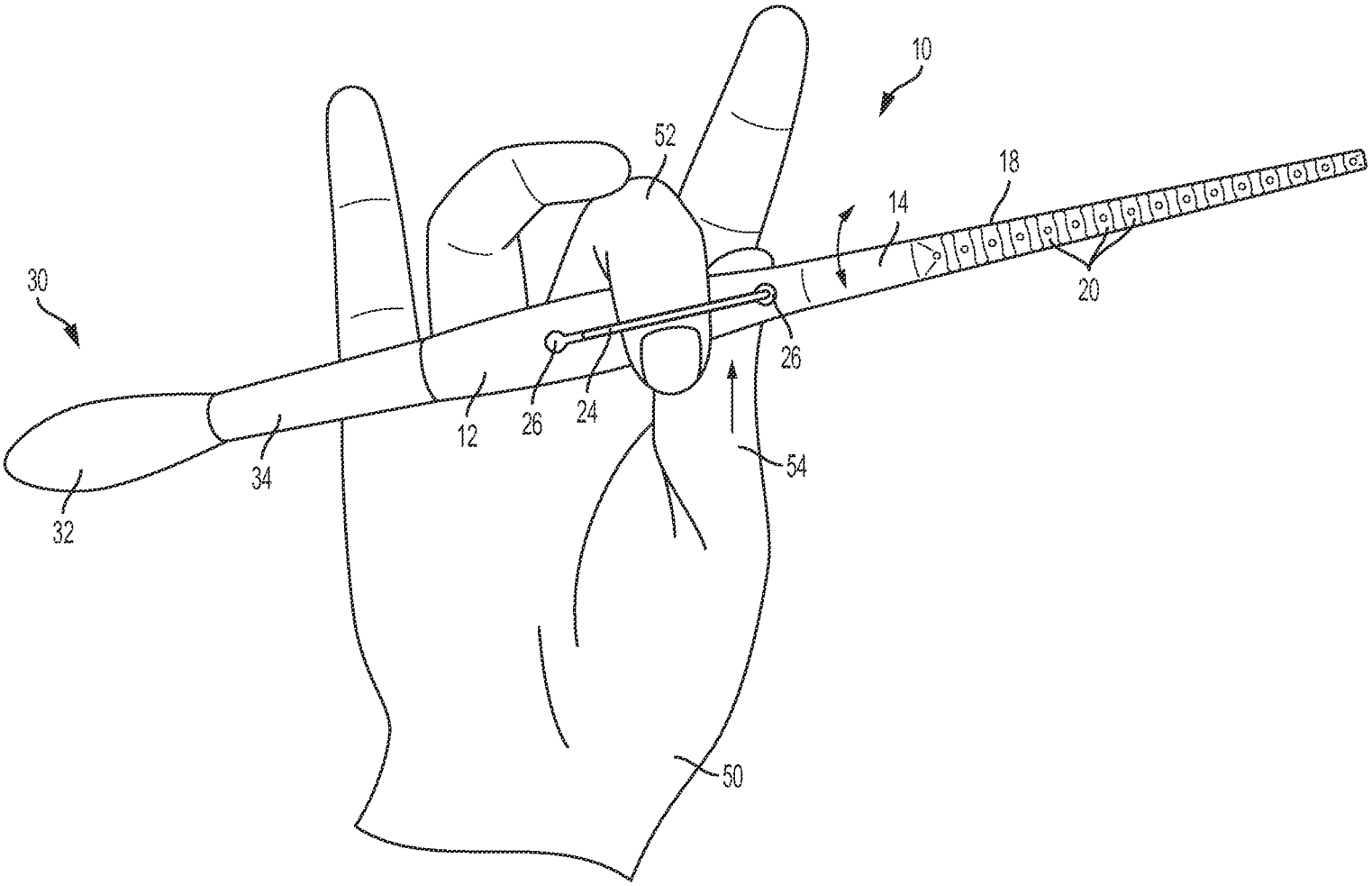
FIG. 3 depicts an elevation view of certain embodiments of the comb shown in use.

In operation, comb apparatus 10 is secured to operator 50 by placing middle finger 52 between support band 24 and handle 12. As depicted in FIG. 2, this connection between middle finger 52, support band 24 and handle 12 orients tines 20 of comb apparatus 10 generally in a vertical plane. This is the resting position of comb apparatus 10. As depicted in FIG. 3, operator 50 presses thumb 54 against a portion of handle 12 or neck 14 to permit tines 20 to pivot downward into a generally horizontal plane. Removal of thumb 54 from handle 12 or neck 14 causes tines 20 to automatically pivot upward into the generally vertical plane. This automatic upward pivotal movement of tines 20 is caused by tension present between support band 24 and middle finger 52.

Operator 50 can perform a scissor over comb technique when cutting an individual's hair (not shown) by using the motions described above. Operator 52 maintains the arm, wrist and hand connected to comb apparatus 10 in a neutrally aligned 45 degree angle relative to a horizontal plane. By pressing thumb 54 against comb apparatus 10 and releasing thumb 54 from the apparatus, operator 50 can quickly pivot tines 20 to the down and up positions as needed to comb or cut the individual's hair. During these motions, the operator's arm, wrist and hand remain in the neutrally aligned position, which reduces the chance the operator suffers a stress injury, or the like. The operator's other free hand maneuvers a pair of scissors to cut the individual's hair. This procedure contrasts conventional combs, which require the operator to pivot the comb up and down by using multiple fingers. This motion is inefficient and places stress on the operator's hand and wrist.

Figure 4:
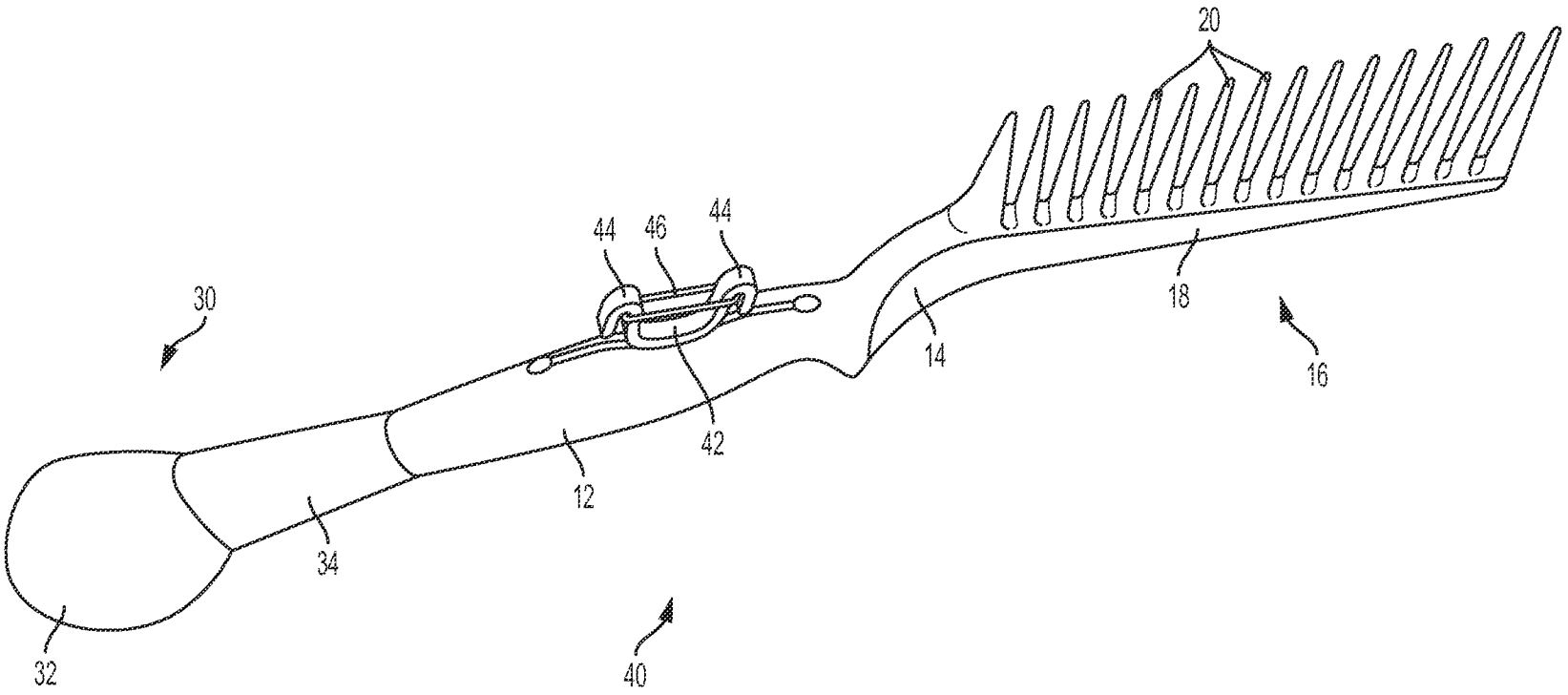
FIG. 4 depicts a perspective view of an alternative embodiment of the comb.
Figure 5:
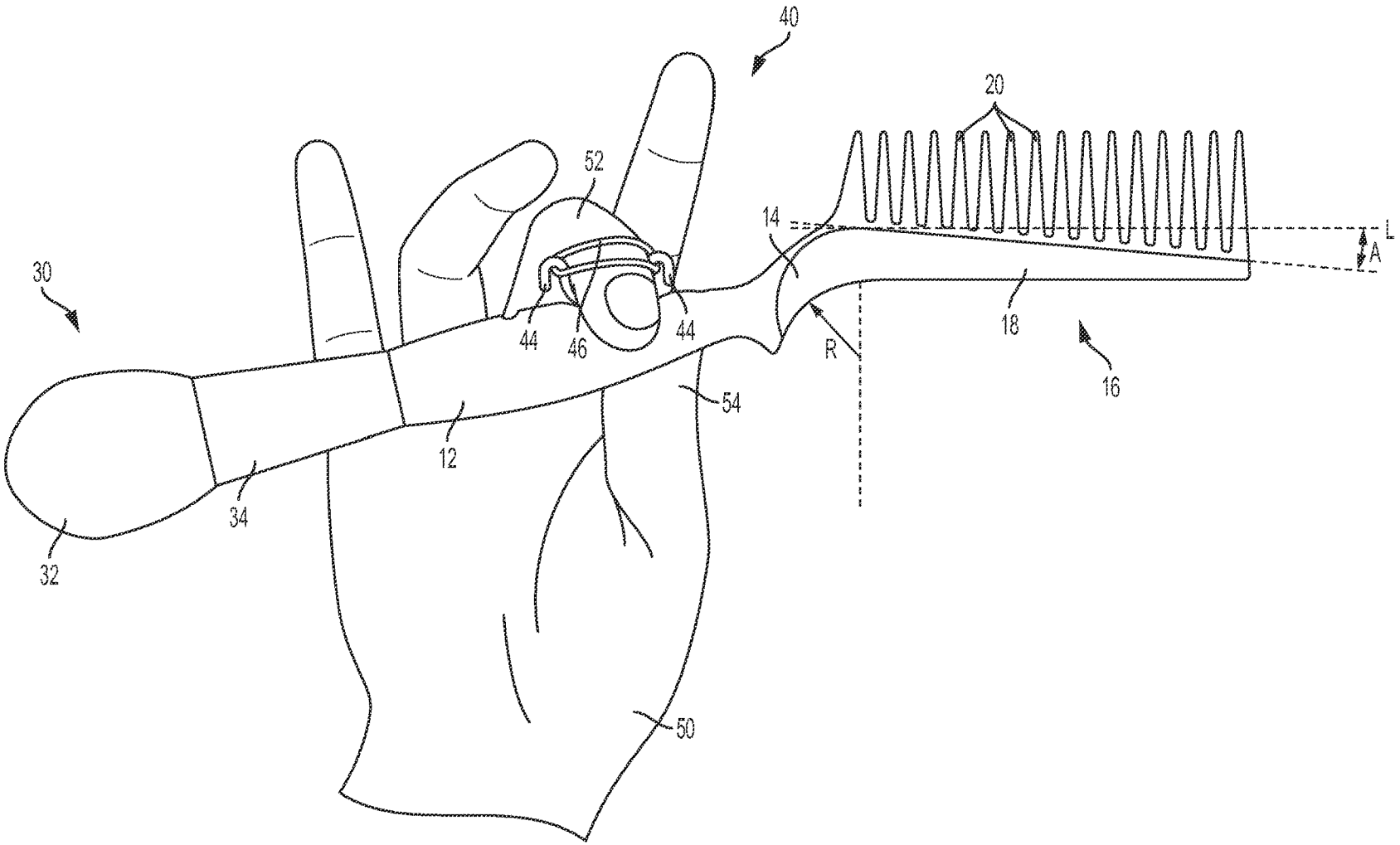
FIG. 5 depicts a front elevation view of the alternative embodiment of the comb shown in use.
Figure 6:
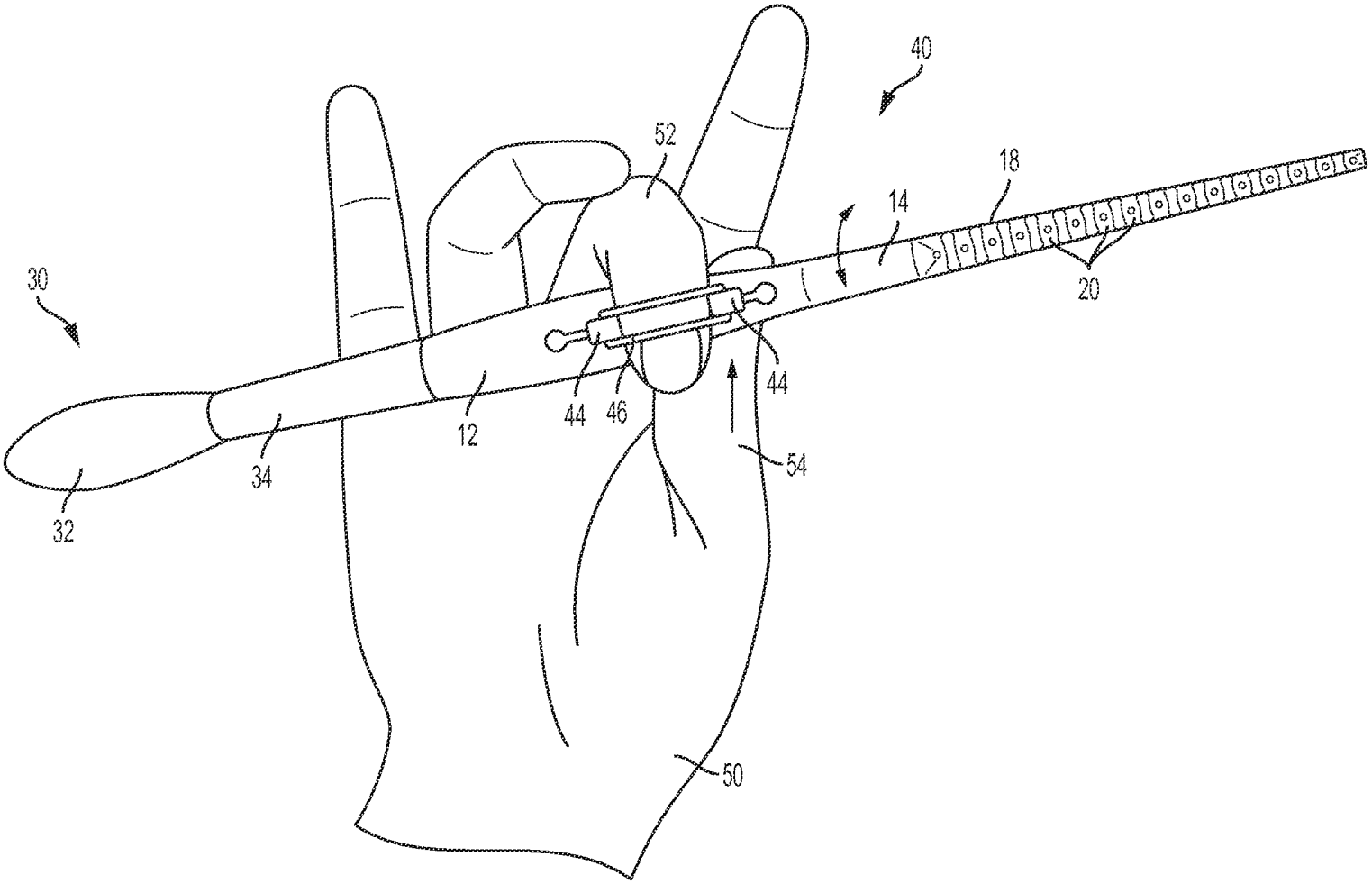
FIG. 6 depicts an elevation view of the alternative embodiment of the comb shown in use.

FIGS. 4-6 depict alternate comb apparatus 40, which comprises components substantially similar to comb apparatus 10 including handle 12, neck 14, comb member 16 and brush 30. Alternate comb apparatus 40 comprises finger rest member 42 rotatably mounted to handle 12. In a preferred embodiment, finger rest member 42 is rotatably mounted to handle 12 by a nail or alternative rod (not shown) that is secured within an opening in handle 12. Finger rest member 42 comprises a pair of hooks 44 configured to secure alternate support band 46. In this configuration, middle finger 52 is disposed between finger rest member 42 and alternate support band 46.

As depicted in FIGS. 5-6, alternate comb apparatus 40 can be pivotably adjusted down or up in the same manner as comb apparatus 10. In addition, alternate comb apparatus 40 provides operator 50 with greater degrees of motion, which enhances efficiency when performing the scissor over comb technique. Since alternate comb apparatus 40 rotates relative to finger rest member 42 and middle finger 52, operator 50 can easily rotate tines 20 to different positions relative to the individual's hair such as the side of the head or the back of the head.

It shall be appreciated that the components of the comb apparatuses described in several embodiments herein may comprise any alternative known materials in the field and be of any color, size and/or dimensions. It shall be appreciated that the components of the comb apparatuses described herein may be manufactured and assembled using any known techniques in the field.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A comb for use in permitting a user to perform a scissor over comb technique on hair of a subject with enhanced efficiency, the comb configured to enable a user to pivotably adjust the comb and maintain the user's hand and wrist in a neutrally aligned position, the comb comprising:

a frame comprising a spine, a neck, and an elongated handle having a proximal end opposite a distal end, the neck comprising a proximal end coupled to the distal end of the handle and a distal end coupled to a proximal end of the spine, where the handle provides a continuous outer surface between the proximal and distal ends thereof and the frame defines a continuous lower surface between the respective proximal and distal ends of the spine, the neck and the handle;

a plurality of tines coupled to an upper surface of the spine disposed opposite the continuous lower surface;

a generally U-shaped finger rest member having: i) a base portion rotatably mounted to an upper surface of the handle, where the upper surface of the handle is disposed opposite the continuous lower surface, and ii) a pair of spaced apart opposing end portions extending upwardly from the base portion and each end portion has a hook continuous connected thereto, wherein the generally U-shaped finger rest member rotates about an axis of rotation which is transverse to the upper surface of the handle such that the U-shaped finger rest member is rotatable to be oriented in alignment, at an angle or transverse to the handle; and a circular support band coupled to the pair of hooks of the finger rest member and extending in space between the opposing ends of the generally U-shaped finger rest member:

where during use, a first finger of the user is disposed between the finger rest member and the support band and a second finger of the user is pressed against the continuous upper surface along the neck to pivot the tines downward into a generally horizontal pane and removal of the second finger from the neck permits tension between the support band and first finger to pivot the tines upward into a generally vertical plane.

2. The comb of claim 1, wherein the neck comprises a radius of curvature that elevates the plurality of tines above the handle.

3. The comb of claim 2, wherein the radius of curvature of the neck is approximately 1 inch.

4. The comb of claim 3, wherein the spine comprises a top slanted surface coupled to the plurality of tines, wherein an angle defined by the top slanted surface and a longitudinal axis of the spine is approximately 4 degrees.

5. The comb of claim 4, wherein the plurality of tines increase in length from a first end of the spine proximate the neck to a second end of the spine.

6. The comb of claim 5, further comprising a brush comprising a bristle portion coupled to an arm portion, the arm portion being detachably coupled to the handle.

* * * * *